US005205073A

United States Patent [19]

Lyons, Sr.

[11] Patent Number: 5,205,073

[45] Date of Patent: Apr. 27, 1993

[54] COUNTERBALANCED DOOR ASSEMBLY WITH REDUCED INITIAL CLOSING FORCE

[76] Inventor: Robert Lyons, Sr., 1060 Ridge Rd., Hamden, Conn. 06517

[21] Appl. No.: 955,314

[22] Filed: Oct. 1, 1992

[51] Int. Cl.[5] ..... E05F 1/10

[52] U.S. Cl. ..... 49/386; 49/379; 52/72

[58] Field of Search ..... 49/386, 379; 52/72

[56] References Cited

U.S. PATENT DOCUMENTS

| | | | |
|---|---|---|---|
| 3,896,595 | 7/1975 | Anghinetti et al. | 49/386 X |
| 4,145,843 | 3/1979 | Lyons | 49/386 |
| 4,873,791 | 10/1989 | Lyons, Sr. | 49/386 |
| 5,067,277 | 11/1991 | Magalotti | 49/379 X |
| 5,136,811 | 8/1992 | Lyons, Sr. | 49/386 |

*Primary Examiner*—Philip C. Kannan
*Attorney, Agent, or Firm*—DeLio & Peterson

[57] ABSTRACT

A door closing mechanism, preferably mounted on a counterbalanced door assembly, which provides a mechanical advantage to close the door and overcome the forces of friction, inertia and any counterbalancing forces. A slot plate with a curved control slot is mounted to the door. A control arm, pivotally mounted at one end to the door frame, has a handle and slot engager mounted at the other end. The slot engager slides along the control slot and pulls the door closed as the handle is pulled. The control slot is preferably curved only along a first portion and straight in a second portion to provide greater mechanical advantage at the beginning of its motion.

17 Claims, 4 Drawing Sheets

COUNTERBALANCED DOOR ASSEMBLY WITH REDUCED INITIAL CLOSING FORCE

BACKGROUND OF THE INVENTION

1. Field of the Invention

This invention relates to hand-operated mechanisms for closing and opening heavy doors and to counterbalanced door assemblies incorporating such mechanisms. The invention is particularly suited for use with heavy counterbalanced doors found in floors, sidewalks and roofs that are horizontally hinged and need to be pulled closed from below. The invention is designed to provide the mechanical advantage needed to overcome friction and move the mass of a large counterbalanced door with a single hand.

2. Description of Related Art

Horizontally hinged doors are commonly used in sidewalks, in the floors of industrial facilities for access to subterranean locations and for roof access in large buildings. Doors of this type are often made of metal, typically steel or aluminum, and due to their weight they are normally counterbalanced for safety and ease of operation.

Quite often such a door will have a fixed ladder mounted below the door. When a user is descending the ladder and desires to close the overhead door, he must be able to do so with one hand while holding onto the ladder with the other hand. In such applications it is desirable to reduce the force that needs to be exerted on the closing handle to close the door.

It is particularly desirable to reduce the force needed on the handle at the initial portion of the door's motion. During this portion of the door swing, the user must pull on the handle at an angle from the ladder which tends to pull him away from the ladder. Moreover, a greater closing force needs to be exerted on the handle at the start of the swing to overcome the hold-open forces of inertia, friction and counterbalancing than is needed to continue the closing motion after the door is moving.

At the other end of the door swing, as the door nears the closed position, the user is pulling down parallel to the ladder. This is relatively easy as the user can use his weight to assist in closing the door.

The prior art has attempted to alleviate problems in closing the door from below by counterbalancing and reducing the friction of the door. A door that is well counterbalanced throughout its swing and that is designed to operate with low friction will decrease the level of closing force needed throughout the swing of the door.

However, often it is not desirable, or for cost reasons it is not feasible, to reduce the friction to near zero or to exactly counterbalance the door throughout its range. For example, in some applications it is desirable to have sufficient friction that the door stays in position when it is released at a midpoint in its swing. In other applications the counterbalancing system may be designed to provide some extra counterbalancing force at the top to ensure that the door will move to the fully open position when released near that position. A slight extra force may also be generated at the top of the swing to hold the door open, however, most doors are mechanically retained in the fully open position so that they will not close inadvertently.

For these reasons, it is preferable to increase the mechanical advantage of the hand-operated closing system provided at the initial portion of the door swing.

Accordingly, it is one object of the present invention to provide a counterbalanced door assembly with a door closing mechanism that can be easily operated with one hand.

It is another object of the invention to provide a counterbalanced door assembly with a door closing mechanism that can be operated by a user on a ladder.

It is yet another object of this invention to provide a counterbalanced door assembly where the initial force required to begin moving the door towards the closed position is reduced as compared to prior art doors.

SUMMARY OF THE INVENTION

The present invention comprises a door closing mechanism which is preferably incorporated into a counterbalanced door assembly to provide a reduced initial closing force. The door is hinged to a frame and swings between an open and a closed position. A slot plate is mounted to the door and includes a curved control slot extending from a first point $P_1$ generally away from the hinge line of the door to a second point $P_2$. A counterbalance mechanism is connected between the door a nd the frame to at least partially counterbalance the weight of the door. A control arm with first and second ends is pivotally mounted at the first end to the frame.

The second end of the control arm has a slot engager mounted to it which slides within the control slot and swings in a closing arc as the door is closed. A handle for closing the door is connected to the control arm, preferably to the slot engager, such that the slot engager slides within the control slot, moving in a control slot path from point $P_1$ to point $P_2$ when the handle is pulled to close the door.

In the preferred embodiment, the control slot includes a locking slot portion extending from point $P_1$ towards the door to a locking point $P_L$. When the slot engager drops into the locking slot portion of the control slot, the door is mechanically retained open until the handle is lifted to pull the slot engager out of the locking slot.

The control slot is curved away from a reference straight line between points $P_1$ and $P_2$. The curved shape of the control slot provides a greater mechanical advantage at the beginning of the closing motion than doors of the prior art type which are provided with a straight control slot between points $P_1$ and $P_2$. The curve in the control slot preferably extends over less than the first half of the distance from $P_1$ to $P_2$, the remaining portion being straight.

BRIEF DESCRIPTION OF THE DRAWINGS

For a fuller understanding of the invention, reference should be made to the following description taken in connection with the accompanying drawing(s), in which.

DETAILED DESCRIPTION OF THE PREFERRED EMBODIMENT

Figure 1:
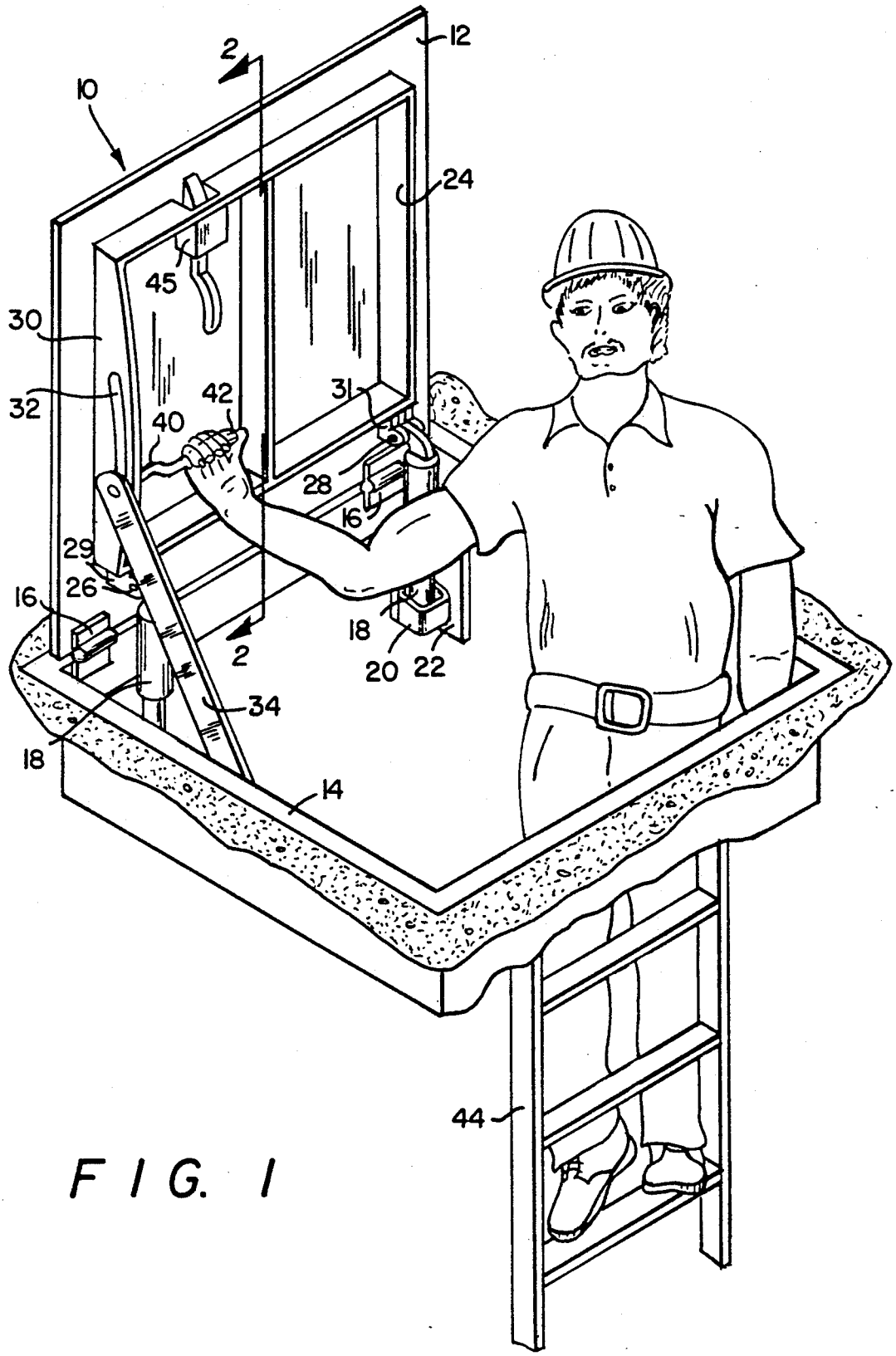
FIG. 1 is a perspective view of a counterbalanced door with a closing mechanism according to the present invention showing the door about to be closed from below.

Referring to FIGS. and 2, a counterbalanced door assembly according to the present invention is generally indicated with reference number 10. The assembly includes a door 12 horizontally hinged to a frame 14 via hinges 16.

A counterbalance mechanism comprising spring cylinders 18 is mounted between the frame 14 and the door 12. Spring cylinders are well known in the art and comprise two cylindrical halves sealed at the ends which slide together about an internal spring. As the door 12 is closed, the springs inside spring cylinders 18 are compressed thereby providing the counterbalancing force. Other types of counterbalancing devices including torque rods, hanging weights and the like may also be used.

The bottom halves of the spring cylinders 18 rest on support shelves 20, which are mounted on members 22, that are in turn attached to the frame 14. The upper ends of the left and right s cylinders 18 connect to the door through yokes 31, 29 connected below the door stiffener 24 and slot plate 30, respectively. The upper end of the left spring cylinder 18 in FIG. 1 is mounted to yoke 29 via a pivot 26 which lets the top connection point rotate as the door is closed. The upper end of the right spring cylinder 18 in FIG. 1 is mounted in a similar manner via pivot 28 to yoke 31. Slot plate 30 acts like door stiffener 24 except that it also includes a curved control slot 32, shown and described in greater detail with reference to FIG. 4.

Figure 2:
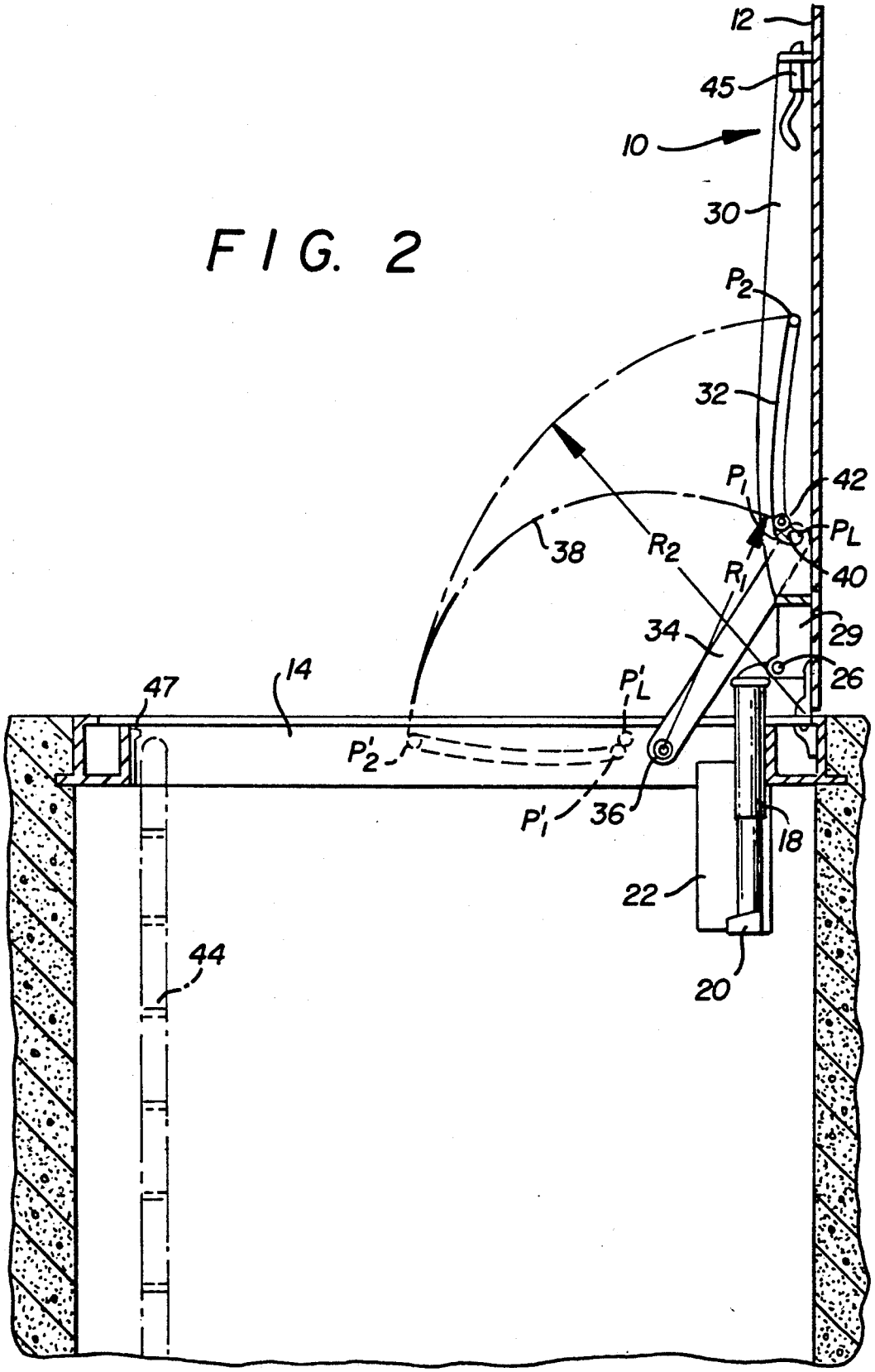
FIG. 2 is a cross-sectional side view along the line 2—2 in FIG. 1 showing the door in the open position.

Referring to FIG. 2, a control arm 34 is pivotally mounted to the frame 14 at a first end near the bottom of the arm 34 via pivot point 36. The second end at the top of arm 34 swings in closing arc about the pivot point 36. The second end of the control arm 34 includes a slot engager 40 mounted thereto which swings in the closing arc 38 of radius $R_1$ shown in broken lines. $R_1$ is the distance between the axis of pivot point 36 and the axis of the slot engager 40.

Figure 3:
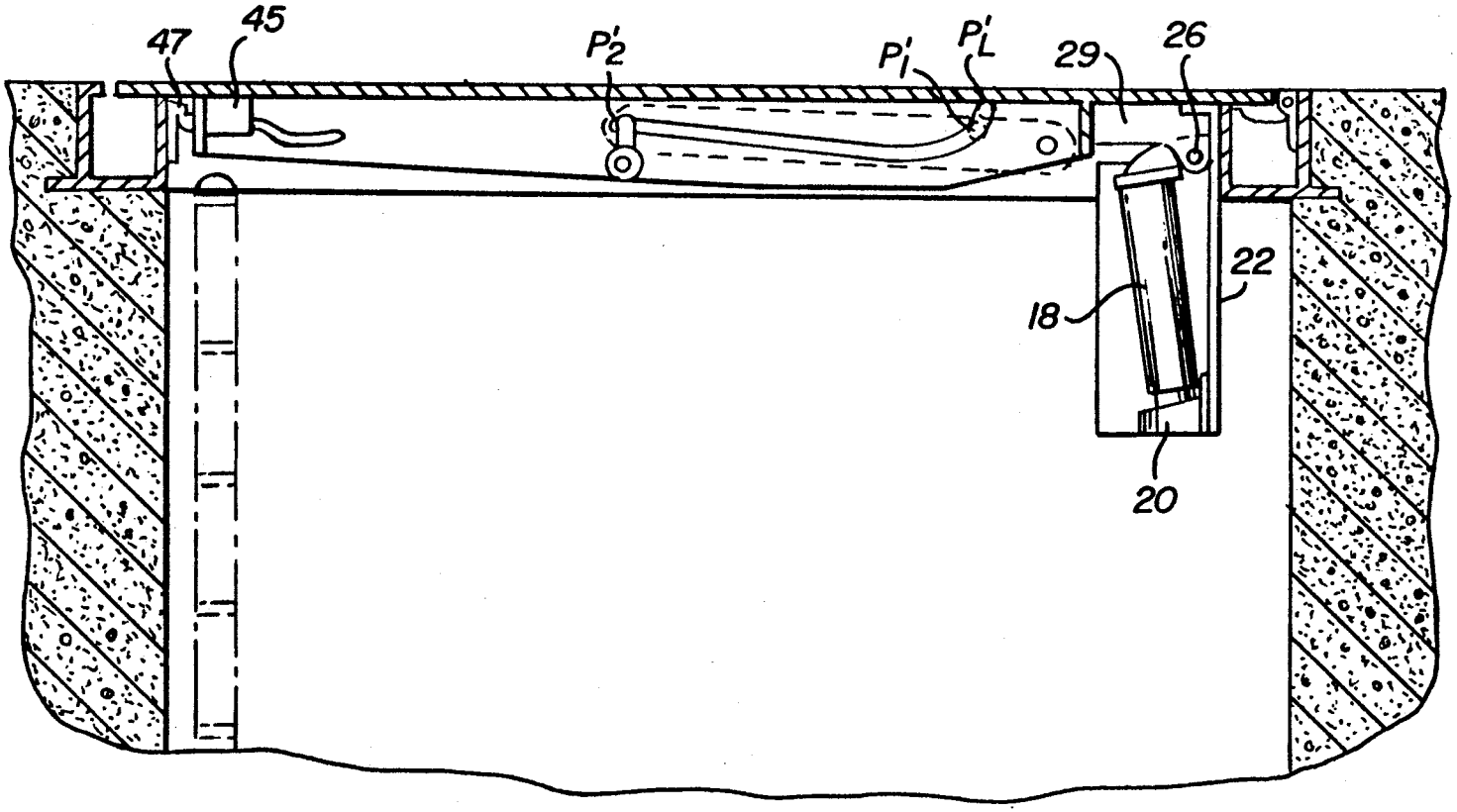
FIG. 3 is a cross-sectional side view showing the door in the closed position.

The slot engager 40 is sized to fit smoothly within the control slot 32 such that its exterior slides along the interior of the slot. As the control arm 34 swings about the pivot point 36, the slot engager moves along the closing arc 38 and brings the door from the open position in FIG. 2 to the closed position in FIG. 3. The slot engager 40 is preferably cylindrical and may be formed from a length of metal rod, such as steel, projecting at right angles from the control arm 34 through the control slot 32.

A handle 42 is connected to the control arm 34, preferably by direct connection to the slot engager, by extending the rod forming the slot engager through the control slot 32 out sufficiently far beyond the plane of the slot plate 30 to form the handle. A soft grip is added to the exterior of the handle for comfort and is given a contrasting color to make the handle easier to locate.

In the preferred design, the rod forming the slot engager is bent twice to offset the axis of the handle from the axis of the slot engager as is shown in FIG. 1. This offset provides clearance from the plane of the door for the handle to be gripped and makes the handle easier to reach by bringing the handle closer to the ladder 44.

To provide a hold open force, the door is designed such that the internal springs of spring cylinders 18 are slightly compressed when the door is fully opened. This is accomplished by selecting an appropriate length for the spring inside the spring cylinders 18 or by adjusting the design point where the support shelves 20 connect to members 22.

The door may be of any desired size. Extra structural members and stiffeners are added, as necessary for the intended application, which may include foot traffic or vehicle traffic on the upper surface of the door. The door and frame are commonly manufactured of steel or heavy gauge aluminum, and sufficient extra counterbalance spring cylinders are added in parallel between the door and the frame to counterbalance the weight of the door.

To close the door from below, handle 42 is pulled along the closing arc 38. As the control arm 34 swings, the door is pulled shut by the slot engager 40 as it slides along the control slot 32 and pulls on the slot plate 30. Ultimately, the door reaches the fully closed position of FIG. 3. Latch 45 then operates to engage the latch plate 47 and secure the door in the closed position.

With the door open, the slot engager is initially located at the locking point $P_L$. This is the position of the control arm and slot engager illustrated in FIG. 2. $P_L$ is located in the locking portion of the control slot which extends from point $P_1$, towards the plane of the door. With the slot engager 40 within the locking portion of the control slot, if a force is applied to the back side of the door 12, the slot engager 40 slides down the locking portion of the control slot towards the door and jams at point $P_L$. This locks the door and holds it open.

In order to close the door, the handle must be pulled along the closing arc 38 at least far enough to bring the slot engager out of the locking portion to point $P_1$. The door may be closed the remainder of the way by continuing to pull the handle from below until the door reaches the position in FIG. 3. As the door closes, the slot engager 40 moves along the control slot 32 until it reaches the far end of the slot at position $P_2$.

As can be seen in FIG. 2, points $P_L$, $P_1$ and $P_2$ travel in arcs concentric about the axis of the door hinges 16 to arrive at corresponding locations $P_L'$, $P_1'$ and $P_2'$ when the door is fully closed.

Figure 4:
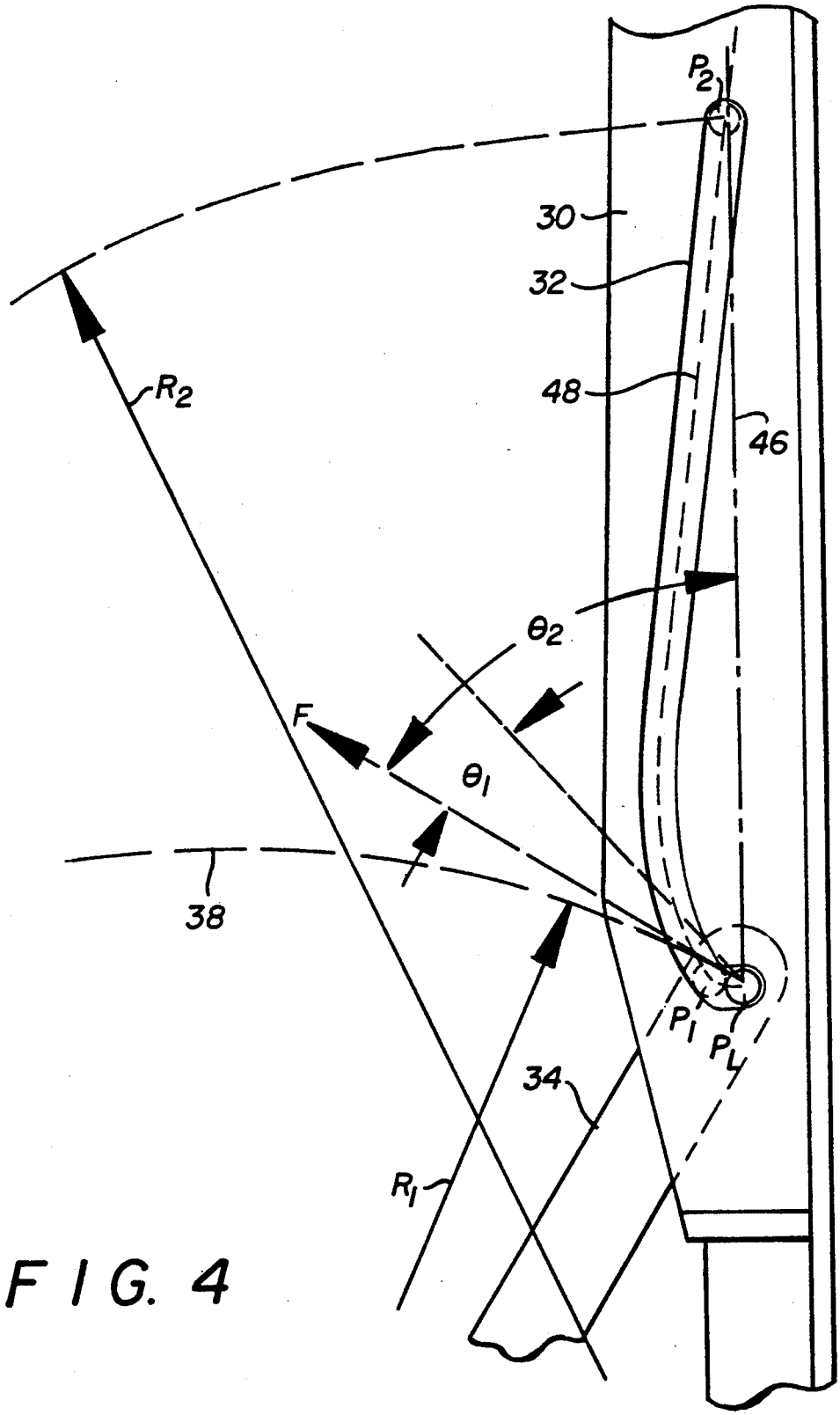
FIG. 4 is a detail view showing the control slot with the door in the open position.

Referring to FIG. 4, a detailed view of the shape of control slot 32 is provided. Starting at the lower end of the slot, the short locking portion is located between points $P_L$ and $P_1$. Then, in a first portion adjacent to point $P_1$ and extending towards point $P_2$, the control slot is curved away from a reference straight line between points $P_1$ and $P_2$ indicated with numeral 46. Finally, in a second portion adjacent to point $P_2$, the control slot is straight and extends at a shallow angle towards the plane of the door 12.

The force F which needs to be exerted on the handle to close the door is shown in FIG. 4 perpendicular to the control arm 34, and tangential to the closing arc 38. The magnitude of the closing force F actually needed at each point along the closing arc 38 varies depending on the friction of the various bearings, the extent of the counterbalancing and the shape of the control slot 32.

The initial force F needed to begin pulling the door closed depends upon the initial friction, the counterbalancing of the door, etc., but also depends significantly upon the starting angle $\Theta$, defined herein as the angle between the tangent to closing arc 38 and the tangent to the control slot path 48 that the slot engager must follow. As the angle $\Theta$ decreases, the initial closing force F decreases.

In prior art designs, the control slot extends in a substantially straight line from point $P_1$ to $P_2$ along the reference straight line 46. A straight line control slot path involves a large starting angle $\Theta_2$ which results in a very high initial closing force F that needs to be applied to the handle. In the present design, the shape of the control slot is adjusted by curving the first portion of the control slot away from the straight line 46 and towards the closing arc 38 to reduce the starting angle to the much lower value $\Theta_1$.

Accordingly, in the present invention the shape of the control slot has been adjusted such that the door swings closed more slowly at the beginning of the control arm motion where the hold-open force must be overcome and faster at the middle and end of the control arm motion where the door is easier to close. This increases the mechanical advantage at the beginning of the control arm swing exactly where it is needed to overcome the hold-open force.

The control slot may be continuously curved over its entire length, however, in the preferred design, only the first portion of the control slot adjacent to $P_1$ is curved. The first curved portion of the control slot generally needs to extend over less than the first 50% of the length of the control slot from point $P_1$ towards $P_2$, and the second portion of the slot can continue straight, extending at an angle to the plane defined by the door. This places the points $P_1$ and $P_2$ approximately the same distance from the plane of the door as would be encountered in a prior art system where the control slot extends straight between points $P_1$ and $P_2$. This reduces the amount of material needed for the slot plate 30, and gives more clearance room below the door.

In the most highly preferred embodiment, the first curved portion of the control slot adjacent to point $P_1$ extends over about 25% of the total length of the control slot path from point $P_1$ to point $P_2$. The locking slot portion of the control slot is optional and is not considered in the control slot lengths referred to above.

As may be seen from the drawings, the door closing assembly comprising the control arm 34, the slot engager 40 and the handle 42 is preferably manufactured as a component of a complete door assembly including also the frame 14 and the door 12 in an integral package ready for installation into a sidewalk or roof. However, the door closing assembly may also be manufactured separately in such a way that it may be attached to preexisting counterbalanced doors by providing a slot plate adapted for connection to the door including the curved control slot and by providing a pivotal attachment point on the first end of the control arm 34 adapted for pivotal mounting on a preexisting door frame.

The door closing assembly of this invention is also well adapted for use with horizontally hinged doors which use a torsion bar counterbalancing method instead of the spring cylinder counterbalances shown herein. In torsion bar designs, the torsion bar is twisted directly as the door swings closed about its hinges. This produces a counterbalancing force that is linearly proportional to the angle of the door relative to the vertical. However, the counterbalancing force needed to exactly balance the weight of the door is a sine function of the angle of the door relative to the vertical. This mismatch between the linear counterbalancing from the torsion bar and the sine function of the weight of the door results in a counter-balancing system which only partially counterbalances the door.

Typically a torsion bar counterbalancing system is over-counterbalanced at the top and bottom of its swing and is under-counterbalanced in the central region. Through the use of the closing assembly of the present invention with a curved control slot, a large mechanical advantage is obtained at the initial closing portion of the control arm swing to overcome the initial over-counterbalancing. A low mechanical advantage occurs in the middle of the swing where the door closes itself due to the under-counterbalancing without any force needed on the closing handle.

In view of the foregoing description it will be apparent that the invention is not limited to the specific details set forth therein for the purposes of illustration, and various other modifications are equivalent for the stated and illustrative functions without departing from the spirit and scope of the invention.

What is claimed is:

1. A counterbalanced door assembly with reduced initial closing force comprising:

a frame;

a door hingedly mounted to the frame at a hinge point for motion between an open and a closed position;

a slot plate mounted to the door including a control slot extending from a first point $P_1$ generally away from the hinge point to a second point $P_2$, the control slot being curved relative to a reference straight line between points $P_1$ and $P_2$;

a counterbalance mechanism connected between the door and the frame to at least partially counterbalance the door;

a control arm having first and second ends, the first end being pivotally mounted on the frame to swing the second end of the control arm in a closing arc as the door is closed;

a handle for closing the door connected to swing the second end of the control arm in the closing arc; and a slot engager mounted to the second end of the control arm, the slot engager engaging and moving along the curved control slot from point $P_1$ to point $P_2$ when the handle is pulled to close the door.

2. A counterbalanced door with reduced initial closing force according to claim 1 wherein the handle is connected to the slot engager.

3. A counterbalanced door with reduced initial closing force according to claim 2 wherein the handle is offset from the slot engager.

4. A counterbalanced door with reduced initial closing force according to claim 1 wherein the control slot comprises a curved first portion of its length adjacent to point $P_1$, and a substantially straight second portion of its length adjacent to point $P_2$.

5. A counterbalanced door with reduced initial closing force according to claim 4 wherein the curved first portion of the control slot extends over less than 50% of the length of the control slot and the straight second portion extends at an angle to a plane defined by the door.

6. A counterbalanced door with reduced initial closing force according to claim 5 wherein the angle of the straight second portion of the control slot to the plane defined by the door is such that the point $P_2$ at the end of the straight portion is at least as close to the plane of the door as the point $P_1$.

7. A counterbalanced door with reduced initial closing force according to claim 5 wherein the curved first portion of the control slot extends over about 25% of the length of the control slot.

8. A counterbalanced door with reduced initial closing force according to claim 4 wherein the control slot includes a locking slot portion extending away from point $P_1$ and generally towards the door.

9. A door assembly with a handle operated closing mechanism comprising:

a frame;

a door hingedly mounted to the frame at a hinge point for motion between an open and a closed position, the door including a control slot lying in a plane perpendicular to the plane of the door, the control slot extending from a first point $P_1$ generally away from the hinge point to a second point $P_2$;

a control arm having first and second ends, the first end being pivotally mounted on the frame; and a handle for closing the door connected to move the second end of the control arm in a closing arc as the door is closed, the second end of the control arm having a slot engager engaging the control slot and moving along the control slot in a control slot path from point $P_1$ to point $P_2$ when the handle is pulled to close the door;

the control slot being curved to reduce the starting angle $\Theta_1$ to a value less than $\Theta_2$, where $\Theta_1$ is defined by the angle between the tangent to the closing arc and the tangent to the control slot path at point $P_1$ when the door is open, and $\Theta_2$ is defined as the angle between the tangent to the closing arc and a reference straight line between $P_1$ and $P_2$ when the door is open.

10. A door assembly according to claim 9 wherein the handle is directly attached to the slot engager.

11. A door assembly according to claim 10 wherein the handle is offset from the slot engager.

12. A door assembly according to claim 9 wherein the control slot includes a first portion of its length adjacent to point $P_1$ which is curved, and a second portion of its length adjacent to slot $P_2$ which is substantially straight.

13. A door assembly according to claim 12 wherein the first curved portion of the control slot extends over less than 50% of the length of the control slot and the second portion which is straight extends at an angle to the plane defined by the door.

14. A door assembly according to claim 13 wherein the second portion of the control slot which is straight extends at an angle towards the plane defined by the door to bring the point $P_2$ at least as close to the plane of the door as the point $P_1$.

15. A door assembly according to claim 13 wherein the first portion of the control slot which is curved extends over about 25% of the length of the control slot.

16. A door assembly according to claim 13 wherein the control slot includes a locking slot portion extending away from point $P_1$ towards the door.

17. A door closing mechanism comprising:

a slot plate adapted for connection to a door including a control slot extending from a first point $P_1$ to a second point $P_2$, the control slot being curved relative to a straight line from $P_1$ to $P_2$;

a control arm having first and second ends, the first end having a pivotal attachment point adapted for pivotal mounting on a door frame and the second end of the control arm having a slot engager slidingly engaging the control slot; and a handle for closing the door connected to the slot engager, the handle swinging the second end of the control arm in a closing arc about the pivotal attachment point on the second end to move the slot engager along the control slot in a control slot path from point $P_1$ to point $P_2$ when the handle is pulled to close the door.

* * * * *

UNITED STATES PATENT AND TRADEMARK OFFICE

CERTIFICATE OF CORRECTION

PATENT NO. : 5,205,073

DATED : April 27, 1993

INVENTOR(S) : Robert Lyons, Sr.

It is certified that error appears in the above-identified patent and that said Letters Patent is hereby corrected as shown below:

Column 2, line 26 "a nd" should read --and--.

Column 3, line 6 "FIGS. and 2" should read --FIGS. 1 and 2--.

Column 3, line 24 "right s cylinders" should read --right spring cylinders--.

Signed and Sealed this

Eleventh Day of January, 1994

Bruce Lehman

*Attest:*

BRUCE LEHMAN

*Attesting Officer*

*Commissioner of Patents and Trademarks*